US011479376B2

(12) United States Patent
Slovencik et al.

(10) Patent No.: US 11,479,376 B2
(45) Date of Patent: Oct. 25, 2022

(54) METHOD FOR CUSHIONING OBJECTS IN A CONTAINER, AND DEVICE FOR CUSHIONING OBJECTS IN A CONTAINER

(71) Applicant: Storopack Hans Reichenecker GMBH, Metzingen (DE)

(72) Inventors: Jean-Marc Slovencik, Uhrwiller (FR); Torsten Junga, Pliezhausen (DE)

(73) Assignee: Storopack Hans Reichenecker GMBH, Metzingen (DE)

( * ) Notice: Subject to any disclaimer, the term of this patent is extended or adjusted under 35 U.S.C. 154(b) by 24 days.

(21) Appl. No.: 16/609,691

(22) PCT Filed: Apr. 30, 2018

(86) PCT No.: PCT/EP2018/061045
§ 371 (c)(1),
(2) Date: Oct. 30, 2019

(87) PCT Pub. No.: WO2018/202628
PCT Pub. Date: Nov. 8, 2018

(65) Prior Publication Data

US 2020/0180804 A1 Jun. 11, 2020

(30) Foreign Application Priority Data

May 2, 2017 (DE) ..... 10 2017 109 375.3

(51) Int. Cl.
*B65B 55/20* (2006.01)
*B65B 57/12* (2006.01)
*B65B 61/22* (2006.01)

(52) U.S. Cl.
CPC ..... *B65B 55/20* (2013.01); *B65B 57/12* (2013.01); *B65B 61/22* (2013.01); *B65B 2210/04* (2013.01)

(58) Field of Classification Search
USPC ..... 53/410
See application file for complete search history.

(56) References Cited

U.S. PATENT DOCUMENTS 4,922,687 A 5/1990 Chow et al.
5,778,631 A 7/1998 Simmons
(Continued)

FOREIGN PATENT DOCUMENTS

CA 2271755 A1 5/1998
DE 689 04 324 T2 5/1993
(Continued)

OTHER PUBLICATIONS

PCT/EP2018/061045 Wirtten Opinion dated May 21, 2019.
(Continued)

*Primary Examiner* — Chinyere J Rushing-Tucker
(74) *Attorney, Agent, or Firm* — Wood Herron & Evans LLP

(57) ABSTRACT

The invention relates to a method for cushioning objects in a container, said method comprising the following steps: a. detecting and/or determining a variable characterizing a residual empty volume of the container by means of at least one sensor, and b. automatically producing at least one cushioning means depending on the variable characterizing the residual empty volume of the container. According to the invention, a cushioning means is produced only when this results from a comparison of the variable characterizing the residual empty volume of the container with a limit value.

12 Claims, 5 Drawing Sheets

(56) References Cited

U.S. PATENT DOCUMENTS

| | | | | |
|---|---|---|---|---|
| 6,095,454 | A * | 8/2000 | Simmons, Jr | B31D 5/0047 242/559 |
| 7,788,884 | B2 | 9/2010 | Cheich et al. | |
| 7,866,125 | B2 | 1/2011 | Simmons, Jr. et al. | |
| 10,293,962 | B2 | 5/2019 | Weinmann et al. | |
| 2005/0050848 | A1* | 3/2005 | Harding | B65B 55/20 53/58 |
| 2008/0098699 | A1 | 5/2008 | Cheich et al. | |
| 2010/0326021 | A1 | 12/2010 | Carlson et al. | |
| 2011/0016833 | A1* | 1/2011 | Carlson | B65B 57/12 53/473 |
| 2011/0308204 | A1* | 12/2011 | Corradi | B65B 57/14 53/472 |
| 2014/0157729 | A1* | 6/2014 | Weinmann | B65B 61/22 53/471 |
| 2015/0210418 | A1* | 7/2015 | Cheich | B65B 59/02 53/471 |

FOREIGN PATENT DOCUMENTS

| | | | |
|---|---|---|---|
| DE | 694 33 887 | T2 | 7/2005 |
| DE | 10 2011 055 455 | A1 | 5/2013 |
| DE | 10 2012 222 805 | B3 | 6/2013 |
| EP | 0 329 496 | A1 | 8/1989 |
| EP | 0921937 | B1 | 10/2000 |
| EP | 0885114 | B1 | 10/2002 |
| EP | 1 556 278 | B1 | 6/2006 |
| EP | 2 743 071 | A2 | 6/2014 |
| FR | 3051774 | A1 | 12/2017 |
| NO | 2008/146111 | A1 | 12/2008 |
| WO | 1995/13914 | A1 | 5/1995 |
| WO | 2007115256 | A2 | 10/2007 |

OTHER PUBLICATIONS

PCT/EP2018/061045 International Search Report dated May 21, 2019.

German Application No. 10 2017 109 375.3 Examination Report dated Dec. 4, 2017.

European Application No. 35020726EP Opposition dated Nov. 23, 2021.

* cited by examiner

METHOD FOR CUSHIONING OBJECTS IN A CONTAINER, AND DEVICE FOR CUSHIONING OBJECTS IN A CONTAINER

The present invention relates to a method for cushioning objects in a container according to the preamble of claim 1. The invention further relates to a device for cushioning objects in a container according to the preamble of the independent claim.

For example, DE 10 2012 222 805 B3 discloses producing a cushioning means from a sheet-like starting material, for example a flat paper strip, by crumpling. In addition, various technologies are known on the market by means of which a cushioning means is produced and introduced into the container depending on a residual void volume in a container in which objects are placed. An example of this is EP 1 556 278 B1.

The problem addressed by the present invention is to provide a method that is as simple as possible and therefore is cost-effective for cushioning objects in a container.

This problem is solved by a method having the features of claim 1 and by a device having the features of the independent claim. Advantageous further developments of the invention are also found in dependent claims. Features important to the invention can also be found in the following description and in the accompanying drawings.

These features may be essential to the invention both in different combinations and in isolation.

According to the invention, a method for cushioning objects in a container is proposed which comprises the steps of: detecting and/or determining a size characterizing a residual void volume of the container by means of at least one sensor, and automatically producing at least one cushioning means depending on the size characterizing the residual void volume of the container. Furthermore, it is proposed that a cushioning means is only produced when this results from a comparison of the size characterizing the residual void volume of the container with a limit value, i.e. if said size reaches and/or exceeds the limit value, for example, or, in another arrangement, does not reach or falls below the limit value. It is preferred that the cushioning means have predetermined dimensions which are independent of the size characterizing the residual void volume of the container. The device according to the invention is designed analogously.

The method according to the invention and the device according to the invention have the advantage that a cushioning means is only produced when it has been determined that the residual void volume is large enough that it justifies the production and the insertion of a cushioning means at all. The production of a cushioning means is therefore based on a yes/no decision and not on a complex evaluation process. This avoids unnecessary production of a cushioning means. This in turn saves time and resources and therefore also costs.

In a further development of the method according to the invention, it is proposed that when a cushioning means is produced, it is automatically transported into the container immediately after production. This saves time, and it relieves the burden on the "packer," i.e. the person who is ultimately responsible for packaging the items in the container.

It is particularly preferred that the cushioning means is transported into the container by gravity. An expensive transport apparatus having a separate drive is thereby saved, which in turn saves costs.

In another specific development, it is proposed for this purpose that the cushioning means be transported into the container along a chute. Therefore, the cushioning means can be accurately and reliably guided into the residual void volume in the container, while achieving low costs and high reliability at the same time, since no drive means are required whatsoever.

In an alternative embodiment, it is provided that the cushioning means is transported into the container by means of a robot. This means that very accurate placement of the cushioning means in the container can be achieved. In addition, the reliability of the placement of the cushioning means in the container is increased.

It is also possible that, when a cushioning means is produced which is not transported into the container immediately after production, this cushioning means is temporarily stored in intermediate storage. This takes into account the fact that, in practice, a cushioning means probably does not need to be transported into each container. The time gained in this way can be used to produce stocks of cushioning means, such that when a cushioning means is to be placed into a container, it is immediately available. This saves time.

A very simple variant of the method is characterized in that the size characterizing the residual void volume of the container has an average height within the interior of the container or in a portion within the interior of the container. According to the invention, therefore, complex determination of a contour of the objects present in the container is not carried out, and complex determination of the geometric distribution of the residual void volume in the container is not carried out either. Instead, for example, only an average height of the objects present in the container is determined, by means of which the residual void volume present in the container can be very well characterized. This can be done, for example, by determining the height at a plurality of predetermined discrete positions. In the simplest case, the arithmetic average can be used as the average. In order to estimate the residual void volume or the size characterizing the residual void volume, it is also useful to know the height of the container.

A further development is characterized in that the size characterizing the residual void volume of the container is determined using the signal from a sensor, in particular a height sensor. Such a sensor may, for example, be a transmitter which operates in a tactile manner, or may be a contactless transmitter, for example an image-capturing apparatus, an ultrasonic sensor and/or a bar code scanner. Using the bar code scanner, for example, a bar code attached to the container either on its outer face or its inner face can be scanned. The information encoded in the bar code may be, for example, a size characterizing the void volume of the container (for example the height of the void volume of the container) and the heights of the objects placed in the container according to a packing list. However, the bar code may also already explicitly contain the size characterizing the residual void volume, or even already contain the yes/no decision as to whether or not a cushioning means should be produced.

In the following, possible embodiments of the invention will be explained with reference to the accompanying drawings, in which.

Figure 1:
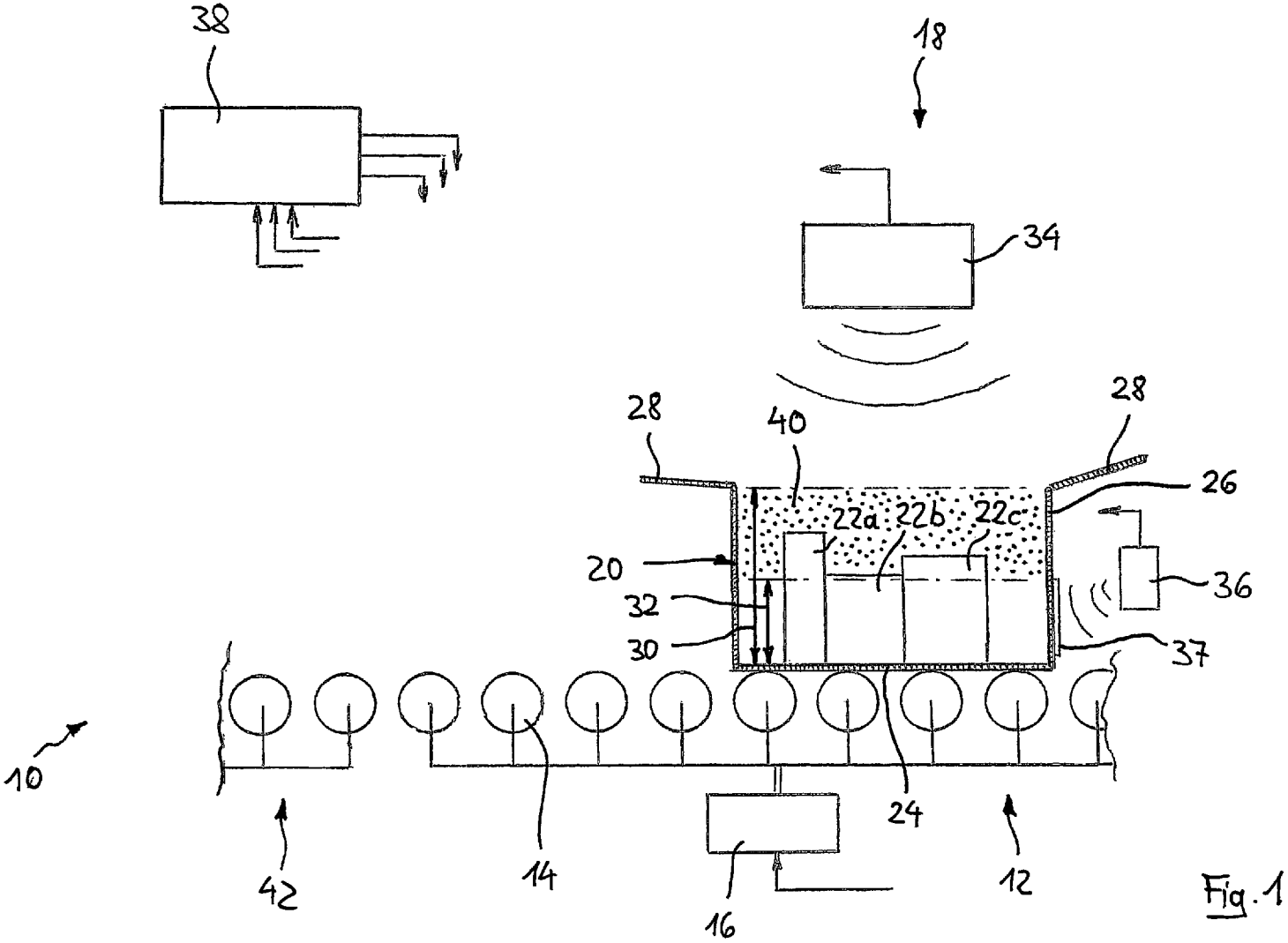
FIG. 1 is a schematic side view of a first portion of a first embodiment of a device for cushioning objects in a container.
Figure 2:
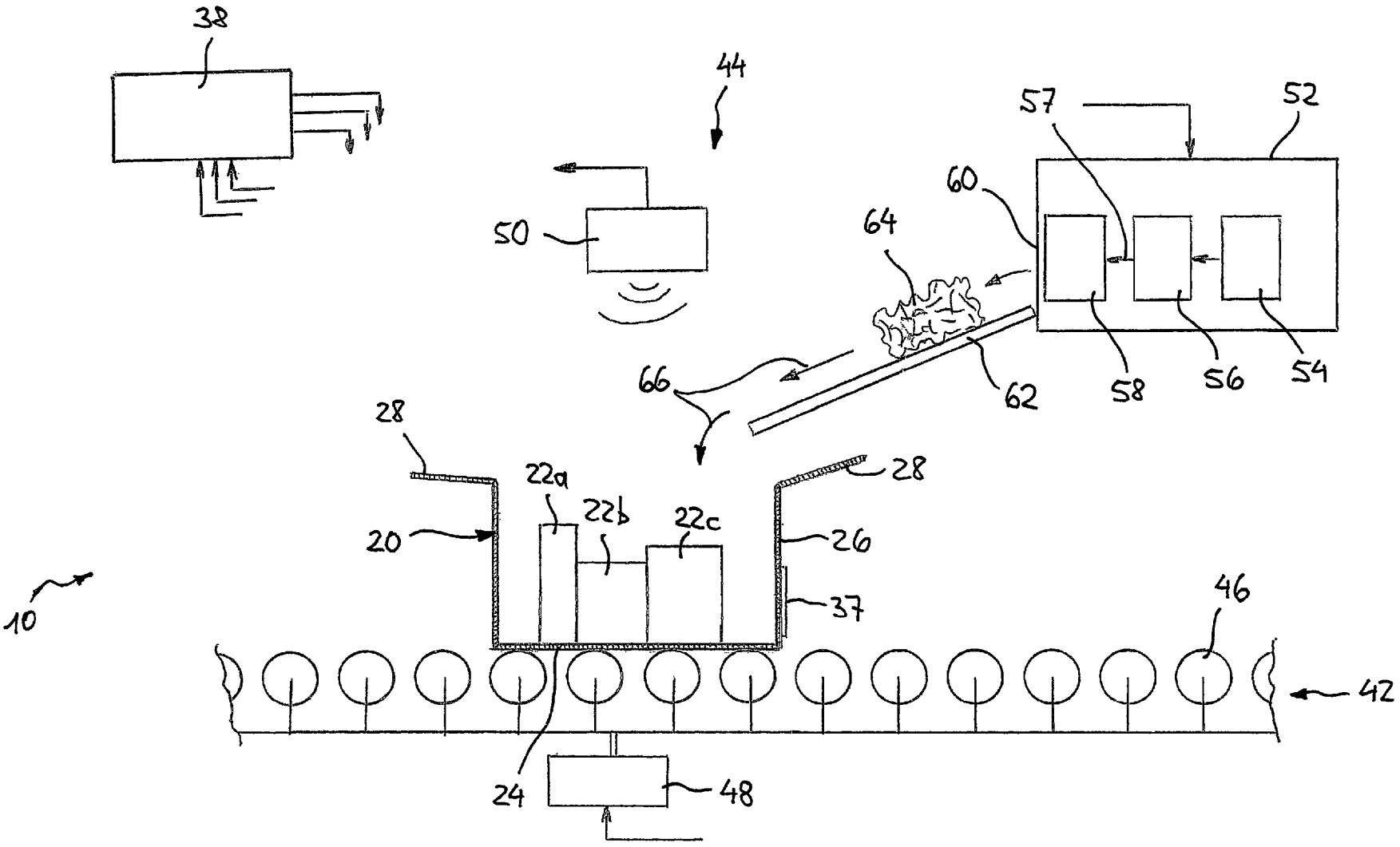
FIG. 2 is a view similar to FIG. 1 of a second region.

A first embodiment of a device for cushioning objects in a container is denoted as a whole by reference sign 10 in FIGS. 1 and 2. It comprises a first transport apparatus 12, which in the present case comprises a roller conveyor having individual rollers 14 arranged in parallel with one another. For reasons of clarity, only one of these rollers is provided with reference sign 14 in FIG. 1. These rollers 14 are kinematically interconnected insofar as they can be rotated by a shared drive 16.

The first transport apparatus 12 belongs to a first station 18 of the device 10, in which a size characterizing a residual void volume of a container is detected. A corresponding container is denoted by reference sign 20 in FIG. 1. It is used to dispatch objects which are arranged in an interior of the container 20 and are denoted therein by reference signs 22*a*, 22*b* and 22*c*.

The container comprises a base 24, side walls 26, and movable flaps 28. Typically, the container is made of cardboard. A height of a void volume of the container 20 is denoted by reference sign 30. An average height within the interior of the container 20 is denoted by reference sign 32. In the present case, such a height that takes into account the heights of the objects 22*a-c* but also takes into account the size of the surface area of the base 24 that is not occupied by the objects 22*a-c* is referred to as the average height 32. In principle, however, other definitions of the "average height" are possible. For example, the average height could also be formed only by the heights of the objects 22*a-c*. Also, in a simple case, the average height could be formed by the arithmetic average of the maximum heights detected in certain sectors (for example, the 4 quadrants) within the interior of the container 20.

In order for it to be possible to determine the average height 32 within the interior of the container 20, a sensor 34 is initially provided, which is arranged above the container 20. The sensor 34 may be an image-capturing apparatus, for example a camera, an ultrasound sensor or even a transmitter that operates in a tactile manner. It is to be understood that the actual height value is determined by a distance measurement which is set in relation to the distance from the base 24 of the container 20.

In order for it to be possible to determine the height 30 of the void volume of the container 20, a sensor 36 is provided in the form of a bar-code scanner. Using this scanner, a bar code 37 arranged on an outer face of a side wall 26 of the container 20 can be read. One piece of information contained in the bar code 37 is said height 30. In principle, however, it is also conceivable for the height 30 of the void volume of the container 20 to also be determined by the sensor 34 or by another lateral sensor.

The operation of the device 10 is controlled by a control apparatus 38. Said control apparatus 38 receives signals, for example from the two sensors 34 and 36, and controls the drive 16 of the first transport apparatus 12, for example.

In FIG. 1, a residual void volume 40 is shown by a dotted line. This is the volume within the interior of the container 20 which results from the difference between the height 30 of the void volume and the average height 32. In this case, the average height 32 is determined by the control apparatus 38 in accordance with the above-described basic calculation options. It is noted that, in this respect, the average height 32 is a size which characterizes the residual void volume 40 in the interior of the container 20, as it is associated with the residual void volume 40 in any case.

FIG. 1 also shows a small part of a second transport apparatus 42 in the lower left-hand region. As can be seen from FIG. 2, this belongs to a second station 44 of the device 10. Like the first transport apparatus 12, the second transport apparatus 42 also comprises a plurality of driven and mutually parallel rollers 46, of which only one is designated by a reference sign for reasons of clarity in FIG. 2. The shared drive of these rollers 46 is designated by reference sign 48 in FIG. 2.

The second station 44 includes a sensor 50, which is shown here above the second transport apparatus 42. In principle, however, an arrangement beside or even below the second transport apparatus 42 is also conceivable. With the sensor 50, the presence of the container 20 in the second station 44 is detected. In this respect, the sensor 50 can be, for example, an ultrasound sensor or a light barrier.

Furthermore, the second station 44 includes a means 52 for producing a cushioning means. In the present case, the means 52 is designed as a device by means of which a cushioning means is produced from a web-shaped starting material, for example a paper material, by crumpling. For this purpose, the means 52 has a paper supply 54, which may be paper rolled on a roll or paper folded in a tray in a zigzag manner.

A crumpling apparatus 56 conveys the web-shaped starting material and compresses it in its longitudinal direction. For this purpose, the crumpling apparatus 56 has two pairs of rollers (not shown) arranged one behind the other in the conveying direction 57, between which the paper is conveyed, the roller pair which is at the rear when viewed in the conveying direction conveying the paper at a lower speed than the front pair of rollers which is at the front when viewed in the conveying direction. As a result, the paper is compressed or crumpled from the first pair of rollers to the second pair of rollers.

When viewed in the conveying direction 57, a separating apparatus 58 is arranged behind the crumpling apparatus 56 which separates a single cushioning means (also referred to as a "cushioning pad") from the crumpled sheet-like material. This separation can be carried out for example by cutting or by tearing, with the separating apparatus comprising a cutting means in one case and a tearing means in the other case.

The separate cushioning means produced in this way passes through an outlet 60 onto a chute 62 which is inclined relative to a horizontal. The inclination thereof is great enough that a cushioning means (denoted in FIG. 2 by reference sign 64) lying on the chute 62 slides downwards due to gravity in a longitudinal direction of the chute 62 and, after leaving the chute 62 at the lower end thereof, falls into the container 20 arranged below the lower end of the chute 62. This is indicated in FIG. 2 by corresponding arrows 66.

Figure 3:
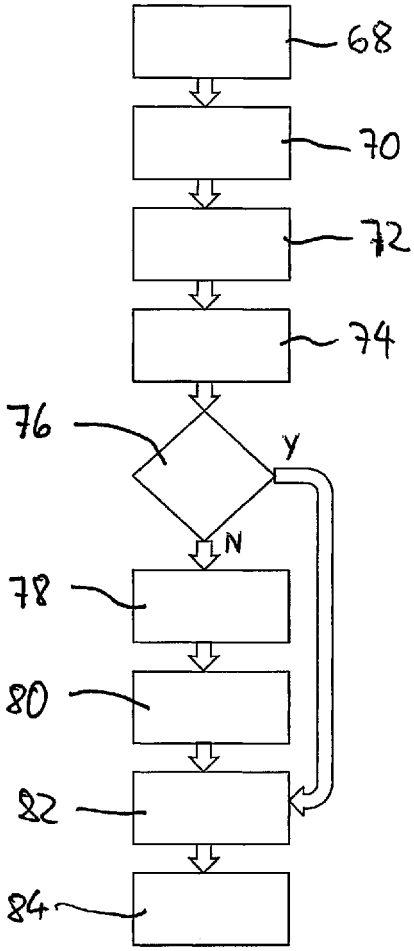
FIG. 3 is a flowchart of a method for operating the device from FIGS. 1 and 2.

Referring now to FIG. 3, a method is described according to which the apparatus 10 shown in FIGS. 1 and 2 and described above operates.

The method begins in a starting block 68. Subsequent to this, in a block 70, the container 20 is transported to the first station 18 by the drive 16 being correspondingly actuated by the control apparatus 38. Once the container 20 is in the first station 18 (which, for example, can also be detected by the sensor 34), the first transport apparatus 12 is stopped. Then, in a block 72, the bar code 37 is read out by means of the sensor 36 and a corresponding signal is transmitted to the control apparatus 38. In a block 74, the height is determined at different points in the interior of the container 20 by means of the sensor 34, and corresponding signals are transmitted to the control apparatus 38.

On the basis of the signals received from the sensor 34, the control apparatus 38 then determines an average height 32 which, as already mentioned above, in conjunction with the height 30 of the void volume of the container 20 transmitted via the sensor 36, is a size characterizing the residual void volume 40 of the container 20. The average height 32 is then compared with a threshold in a block 76. The further course of the method depends on the result of this comparison.

If the average height 32 does not reach the limit value (which is an indication that the residual void volume 40 has a certain minimum dimension), the container 20 is transported to the second station 44 in a block 78. For this purpose, the two transport apparatuses 12 and 42 are set in operation accordingly by the control apparatus 38. Once the container 20 is located solely on the second transport apparatus 42, the first transport apparatus 12 can be stopped or driven independently of the second transport apparatus 42 in order to transport another container 20 into the first station 18. Once the container 20 is in the second station 44, which is detected by the sensor 50, the means 52 is started up by the control apparatus 38 in a block 80 and the cushioning means 64 is produced.

In this case, the production of the cushioning means 64 may also be dependent on information that has been transmitted to the control apparatus 38 by the bar code 37 on the container 20 being read out. For example, this information may include an indication of the size of the container 20, such that a larger or smaller cushioning means 64 is accordingly produced. However, it is preferred that the cushioning means 64 have predetermined dimensions which are independent of the size characterizing the residual void volume of the container (in the present case, therefore, independent of the average height 32).

The control apparatus 38 comprises a timing element which allows a certain time to elapse after the production of the cushioning means 64 before the control apparatus 38 causes the container 20 to be further transported into a downstream station (not shown) in a block 82 by the drive 48 being accordingly actuated. This time limit ensures that the produced cushioning means 64 has reached the container 20 via the chute 62 before the container 20 is transported out of the second station 44. The method ends in a block 84.

The method variant has just been described which proceeds when the control apparatus 38 determines in block 76 that the average height 32 does not reach the predetermined limit value. However, if the objects 22*a-c* are relatively large compared with the container 20, it is also possible that the average height 32 is relatively large and, accordingly, the residual void volume 40 of the container 20 is relatively small. In such a case, the average height 32 in decision block 76 may reach or exceed the limit value. The method then jumps from block 76 to block 82, which is indicated in FIG. 3 by a corresponding arrow. Therefore, a cushioning means 64 is not produced and stored in the container 20. Instead, the container 20 is transported from the first station 18 through the second station 44 and immediately on to a downstream station.

It is thus noted that, in decision block 76, a yes/no decision is made which means, in the present embodiment, either that a cushioning means 64 is produced and stored in the container 20 or that a cushioning means 64 is not produced and is thus not stored in the container 20 either. It should be understood that the term "a" cushioning means 64 as used above does not mean that, in principle, only a single cushioning means 64 is produced. It is understood that, in block 80, a multi-part cushioning means 64 can be produced.

It has been described above that the cushioning means 64 is transported along a chute 62 into the container 20. In principle, however, other apparatuses for transporting the cushioning means into the container are also conceivable. For example, a robot could also be used for this purpose, as can be seen from FIGS. 4 and 5, which show a second embodiment of a device 10 for cushioning objects in a container. In this case, such elements and regions that have equivalent functions to the embodiment in FIG. 1-3 have the same reference signs. Normally they will not be explained again in detail.

Compared to the rather schematic view of the first embodiment in FIGS. 1 and 2, FIGS. 4 and 5 show the second embodiment in greater detail. A support structure 86 made up of standard profiles which comprises a total of four vertical stands 88 can be seen. A frame 90, which in turn supports a grid-like holding plate 92, is retained above the first transport apparatus 12 and the second transport apparatus 42 thereby.

Two sensors (not shown in FIGS. 4 and 5) are arranged on the holding plate 92 with the function that the sensor 34 has in the embodiment in FIGS. 1 and 2. When viewed in the conveying direction of the two transport apparatuses 12 and 42, said two sensors are arranged one behind the other. Above the two sensors, a receiving channel 94, for example made of sheet metal, is arranged on the holding plate 92, in which a crumpled cushioning means 64, which is tubular in the present case, is deposited when it has been produced by the means 52 for producing the cushioning means 64 which are likewise arranged on the holding plate 92.

Two of the vertical stands 88 of the support structure 86 also support a buffer rack 96, in which cushioning means 64 that have been produced but are not yet required can be temporarily stored. It can be clearly seen from FIGS. 4 and 5 that the cushioning means 64 temporarily stored in the buffer rack 96 are all identical. Unlike the embodiment of FIGS. 1 and 2, the paper supply is not shown here. Only a storage plate 98 is shown, on which a stack (not shown, as mentioned previously) of zigzag-folded sheet-like paper material can be stored. As already mentioned, the sheet-like paper material is double-layered, such that it can be reshaped in the means 52 to form the crumpled tubular cushioning means 64.

Figure 4:
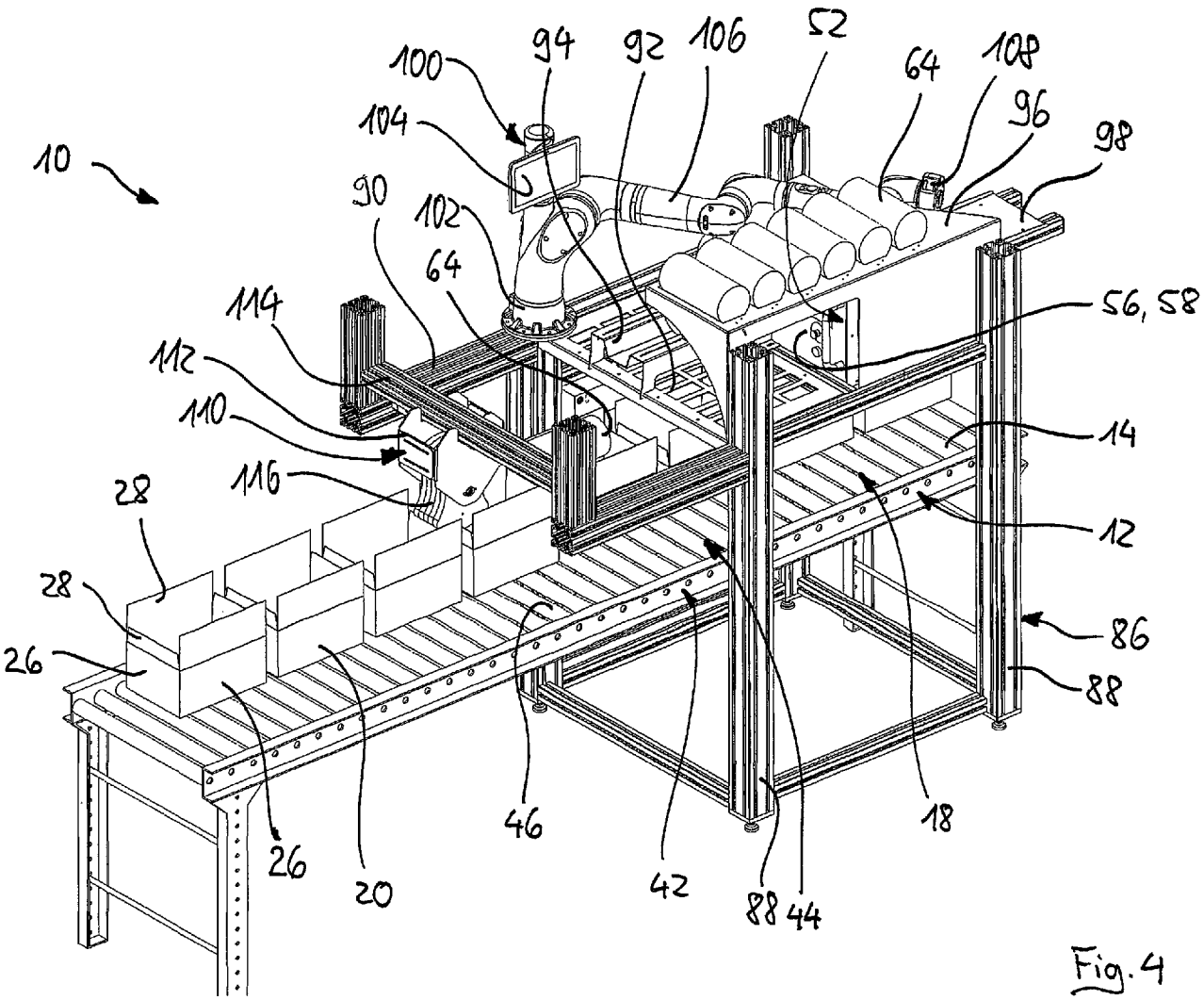
FIG. 4 is a first perspective view of a second embodiment of a device for cushioning objects in a container.
Figure 5:
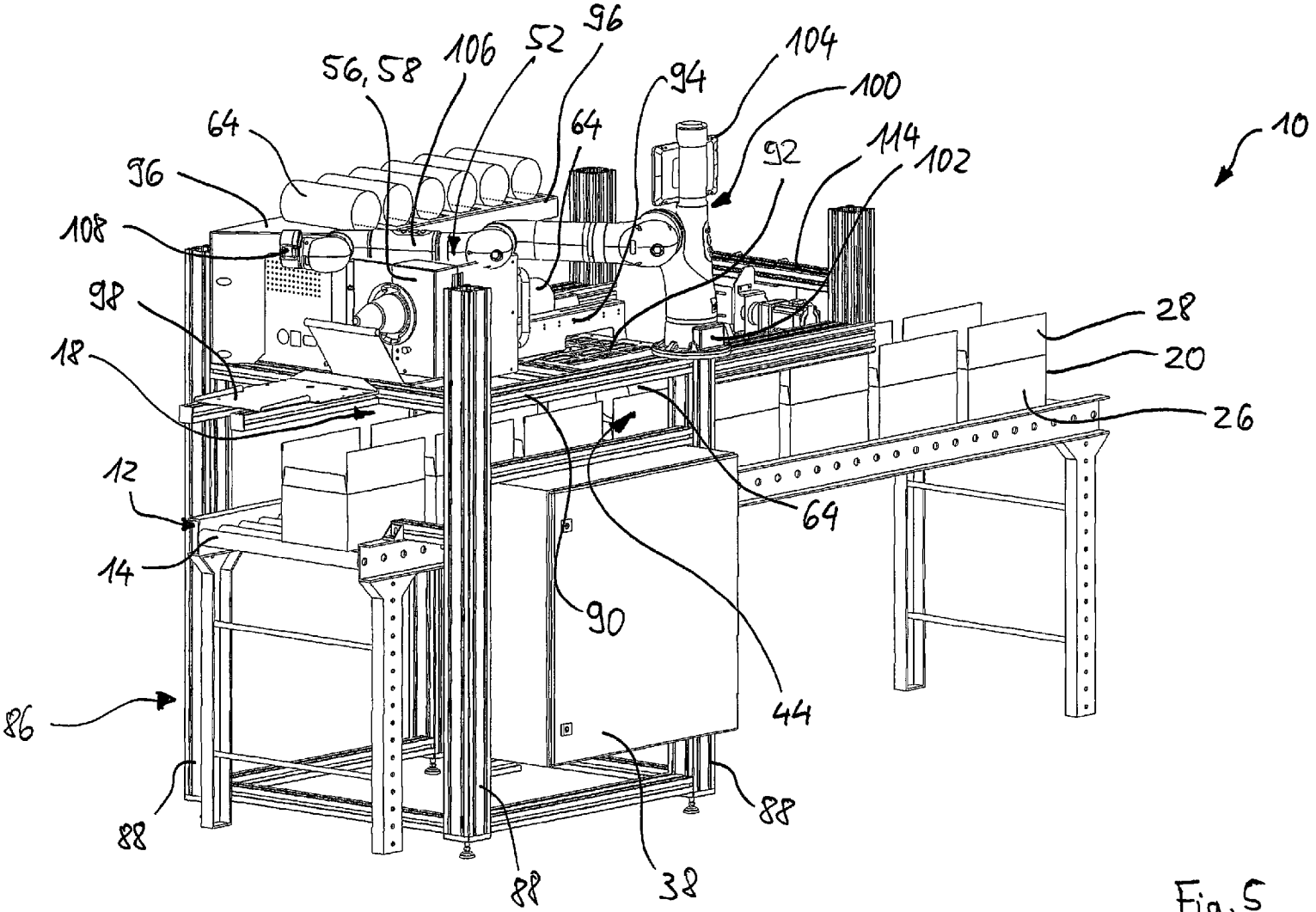
FIG. 5 is a second perspective view of the device from FIG. 4.

Unlike in the embodiment of FIGS. 1 and 2, in the embodiment of FIGS. 4 and 5 the cushioning means 64 does not enter the container 20 via a chute, but by means of a robot 100. Such robots are also called "pick-and-place robots." The robot 100 comprises a base 102 which is screwed to the frame 90 above an upright 88. A touch-sensitive screen 104 (touch screen) is arranged on the base 102, by means of which the robot 100 can be programmed. The robot 100 has a robot arm 106 provided with a plurality of articulated joints, which arm is provided with a gripping apparatus 108 at its projecting end. It is clear that the robot is also connected to the control apparatus 38 and is actuated thereby.

Finally, the device 10 also includes a hold-down means 110. This comprises a holding structure 112 which is fastened to a cross member 114 of the frame 90. Furthermore, the hold-down means 110 comprises a rotor 116 which is rotatably and eccentrically mounted on the holding structure 112 and has a bone-like cross section when viewed from the side.

The device 10 in FIGS. 4 and 5 essentially operates similarly to that in FIGS. 1 and 2. That is to say, an average height of the residual void volume in a container 20 is determined either indirectly or directly in the first station 18 by means of the sensors (not shown). Temporarily storing this information on a label by means of a bar code is not necessary here, since the second station 44 immediately follows the first station 18. If this were also the case in the embodiment shown in FIGS. 1 and 2, the detour of the bar code could also be omitted here.

The controller 38 then determines, in the sense of a yes/no decision, for example by means of a limit comparison, whether the determined average height is large enough that a cushioning means 64, which in the simplest case is always the same, is to be placed into the container 20, or whether the determined average height is small enough that no cushioning means 64 is to be placed in the container 20. In this case, only one of the two sensors is used in a correspondingly short container, whereas, in a longer container, both sensors are used to determine the average height and, for example, an average value for the average height is formed.

When a cushioning means 64 is intended to pass into a container 20, a cushioning means 64 located either in the receiving channel 94 or in the buffer rack 96 is gripped by the robot arm 106 of the robot 100 by means of the gripping apparatus 108 and is placed into the corresponding container 20 in the second station 44. If a cushioning means 64 has been placed in a container 20, the corresponding container 20 is transported as far as below the hold-down means 110 by the second transport apparatus 42. Here, the cushioning means 64 is pressed into the container 20 by a rotational movement of the eccentrically mounted rotor 116, which runs synchronously to the further transport of the container 20 by means of the second transport apparatus 42, such that the flaps 28 of the container 20 can then be easily closed.

It is clear that the robot 100 not only serves to place cushioning means 64 into the container 20, but also serves to transport cushioning means 64 which are produced by the crumpling apparatus 56 of the means 52 but are not intended to be placed immediately into a container 20 from the receiving channel 94 into the buffer rack 96.

Furthermore, the cushioning means could be transported into the container by means of a "revolver." Such a revolver is constructed similarly to a rotating carousel and receives the cushioning means at a receiving station, transports it along a circular path over the container, where it then falls from a discharge station into the container.

The invention claimed is:

1. A method for cushioning objects in a container, comprising the steps of:

detecting and/or determining a size characterizing a residual void volume of the container by means of at least one sensor, executing a comparison of the size characterizing the residual void volume of the container with a limit value, determining a result from the comparison, representing if said size reaches and/or exceeds the limit value, or does not reach or falls below the limit value, and depending on the result deciding whether or not to automatically produce at least one cushioning means depending on the size characterizing the residual void volume of the container, wherein, if said size does not reach or falls below the limit value, no cushioning means is produced, and wherein, if said size reaches or exceeds the limit value, automatically producing the at least one cushioning means, wherein the at least one cushioning means is a cushioning means that has dimensions that are predetermined and independent of the size characterizing the residual void volume of the container.

2. The method according to claim 1, wherein when a cushioning means is produced, it is automatically transported into the container immediately after production.

3. The method according to claim 2, wherein the cushioning means is at least also transported into the container by gravity.

4. The method according to claim 3, wherein the cushioning means is transported into the container along a chute.

5. The method according to claim 1, wherein the cushioning means is transported into the container by means of a robot.

6. The method according to claim 5, wherein when a cushioning means is produced which is not transported into the container immediately after production, this cushioning means is temporarily stored in intermediate storage.

7. The method according to claim 1, wherein the size characterizing the residual void volume of the container comprises an average height within the interior of the container or in a portion within the interior of the container.

8. The method according to claim 1, wherein the size characterizing the residual void volume of the container is determined using the signal from a sensor, in particular a height sensor.

9. The method according to claim 1, wherein the size characterizing the residual void volume of the container is determined using a size characterizing a void volume of the container without objects.

10. A device for cushioning objects in a container, which comprises:

a means for detecting and/or determining a size characterizing a residual void volume of the container, a means for producing at least one cushioning means depending on the size characterizing the residual void volume of the container, and a control apparatus for an actuation of the means for producing the at least one cushioning means, wherein a decision whether or not this actuation is executed depends on a result from a comparison of the size characterizing the residual void volume of the container with a limit value, wherein the result represents if said size reaches and/or exceeds the limit value, or does not reach or falls below the limit value, wherein, if said size does not reach or falls below the limit value, the control apparatus commands that no cushioning means is produced, and wherein, if said size reaches or exceeds the limit value, the control apparatus commands that the at least one cushioning means be produced, wherein the means for producing the at least one cushioning means produces the at least one cushioning means which has predetermined dimensions that are independent of the size characterizing the residual void volume of the container.

11. The device according to claim 10, wherein the device comprises a chute, by means of which a produced cushioning means passes into the container by gravity.

12. The device according to claim 10, wherein the means for detecting and/or determining a size characterizing the residual void volume of the container comprises an image-capturing apparatus, an ultrasonic sensor and/or a bar code scanner.

* * * * *